US011032651B2

(12) United States Patent
Duan et al.

(10) Patent No.: US 11,032,651 B2
(45) Date of Patent: Jun. 8, 2021

(54) PIEZOELECTRIC MICROPHONE

(71) Applicant: AAC Acoustic Technologies (Shenzhen) Co., Ltd., Shenzhen (CN)

(72) Inventors: Lian Duan, Shenzhen (CN); Rui Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 42 days.

(21) Appl. No.: 16/702,598

(22) Filed: Dec. 4, 2019

(65) Prior Publication Data

US 2020/0213771 A1 Jul. 2, 2020

(30) Foreign Application Priority Data

Dec. 31, 2018 (CN) ..... 201811650239.8

(51) Int. Cl.
*H04R 31/00* (2006.01)
*H04R 17/02* (2006.01)

(52) U.S. Cl.
CPC ..... *H04R 17/02* (2013.01); *H04R 31/003* (2013.01); *H04R 2231/003* (2013.01)

(58) Field of Classification Search
CPC ..... H04R 17/02; H04R 31/003; H04R 2231/003; H04R 2201/003
See application file for complete search history.

(56) References Cited

U.S. PATENT DOCUMENTS 9,036,838 B2 * 5/2015 Chen ..... H04R 7/06 381/174
9,055,372 B2 * 6/2015 Grosh ..... H01L 41/27
10,293,377 B2 * 5/2019 Guedes ..... B06B 1/0603

FOREIGN PATENT DOCUMENTS

CN 104219598 A1 12/2014
CN 206302568 B1 7/2017
CN 108282730 A1 7/2018

OTHER PUBLICATIONS

PCT search report dated Jan. 16, 2020 by SIPO in related PCT Patent Application No. PCT/CN2019/113283 (4 Pages).
1st Office Action dated Mar. 30, 2020 by SIPO in related Chinese Patent Application No. 201811650239.8 (13 Pages).

* cited by examiner

*Primary Examiner* — Brian Ensey
(74) *Attorney, Agent, or Firm* — W&G Law Group LLP

(57) ABSTRACT

The present application provides a piezoelectric microphone, including a substrate having a back cavity and a piezoelectric cantilever diaphragm fixed to the substrate. The piezoelectric cantilever diaphragm includes a first diaphragm located at its center and suspended above the back cavity, and a second diaphragm fixed to the substrate and provided around the first diaphragm. The second diaphragm includes a fixed end fixed to one side of the substrate and a movable end close to the first diaphragm side and suspended above the back cavity. The piezoelectric microphone further includes one or more elastically stretchable members each connecting the first diaphragm with the movable end. The piezoelectric microphone of the present disclosure has better performance.

9 Claims, 5 Drawing Sheets

30

200

130

PIEZOELECTRIC MICROPHONE

TECHNICAL FIELD

The present disclosure relates to the field of electroacoustic conversion, and more particularly, to a piezoelectric microphone.

BACKGROUND

MEMS microphones have been widely used and popularized in consuming electronic products. A conventional MEMS microphone is mainly a condenser microphone, and it includes a substrate, and a back plate and a diaphragm that are formed on the substrate. The diaphragm and the back plate form a capacitor system. Vibrations of sound waves will drive the diaphragm of the microphone to vibrate in a reciprocation manner, thereby changing a distance between the diaphragm and the back plate and a value of a plate capacitance. By detecting a change in the capacitance, a sound signal can be converted into an electrical signal. When the mobile device is in a dusty environment, particles in air easily enter and get caught between the diaphragm and the back plate of the microphone, such that the diaphragm cannot move. When the mobile device is in a humid environment, it is easy for water droplets to condense between the diaphragm and the back plate of the microphone, so that the diaphragm and the back plate are adhered by the water droplets. Both of the above conditions can cause the microphone to fail. In order to avoid such problems, piezoelectric MEMS microphones have emerged.

A fabrication process of the piezoelectric microphones is simple, and a design framework employing a single-layer membrane makes it unrestricted by air damping, such that an SNR is naturally improved. In addition, the piezoelectric microphone only includes the diaphragm, and does not include the back plate, which fundamentally eliminates harm caused by the particles and water vapor in the air to the microphone, thereby greatly improving reliability of the microphone.

Lots of diaphragm flaps of the diaphragm of the piezoelectric microphone in the related art have one end fixed and one end being a free cantilever structure, and the cantilever structure is used to avoid an influence of residual stress in the process on acoustic performance. When an external sound signal is introduced from a sound hole, a sound pressure causes the cantilever to deform and generate a voltage change, thereby sensing an acoustic signal.

However, as shown in FIG. 1A and FIG. 1B, the piezoelectric microphone in the related art is subjected to the residual stress, the free end of the diaphragm flap of the diaphragm 1 will be deformed. Moreover, since a stress distribution of an entire substrate 2 during a processing process is uneven, a deformation of the free end of the different diaphragm flap varies. A difference in a structure of the diaphragm flap of the diaphragm 1 further affects the performance of the microphone, resulting in a poor performance of the microphone.

Therefore, it is necessary to provide an improved piezoelectric microphone to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Embodiment 1

Figure 1A:
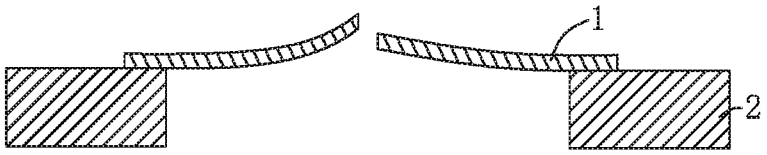
FIG. 1A and FIG. 1B are cross-sectional structural schematic diagrams of a piezoelectric microphone in the related art.
Figure 1B:
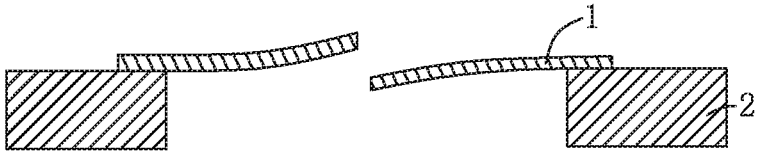
Figure 2:
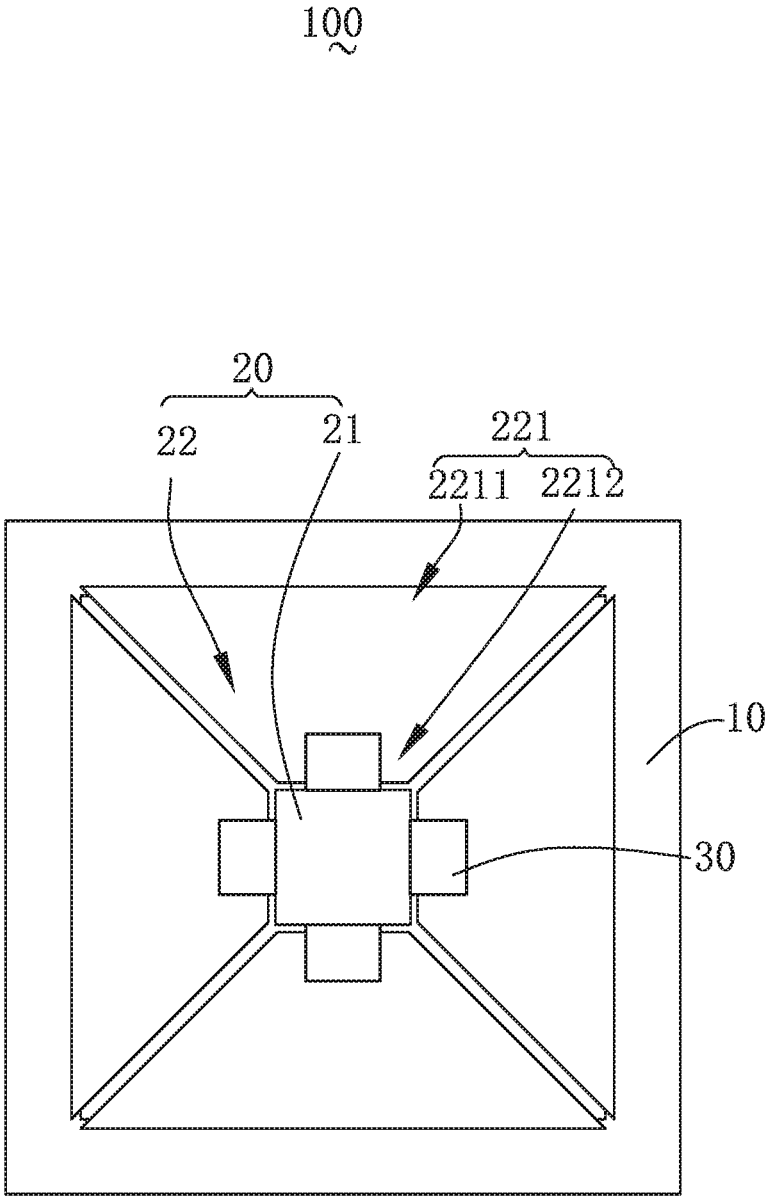
FIG. 2 is a structural schematic diagram of Embodiment 1 of a piezoelectric microphone according to the present disclosure.
Figure 3:
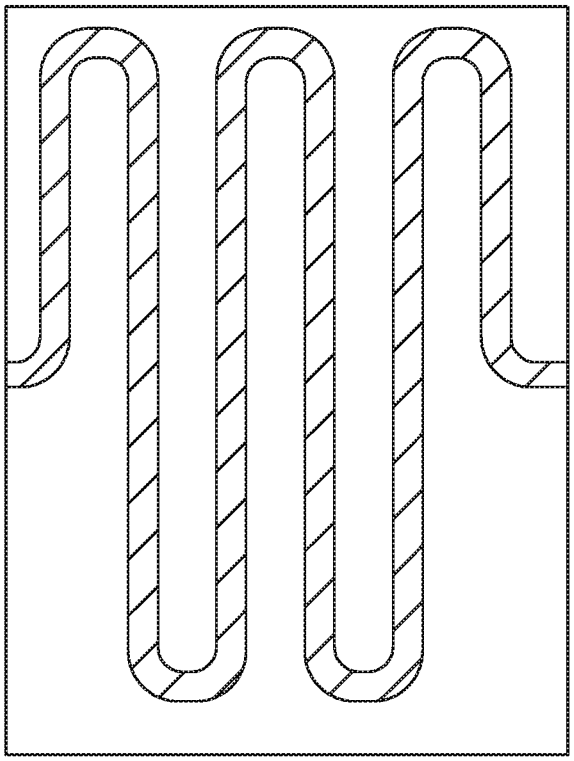
FIG. 3 is a structural schematic diagram of an elastically stretchable member shown in FIG. 2.

Referring to FIG. 2 and FIG. 3 in conjunction, this embodiment provides a piezoelectric microphone 100, and it includes a substrate 10 having a back cavity, a piezoelectric cantilever diaphragm 20 fixed to the substrate 10, and an elastically stretchable member 30 fixed to the piezoelectric cantilever diaphragm 20.

The piezoelectric cantilever diaphragm 20 includes a first diaphragm 21 located at a center and suspended above the back cavity, and a second diaphragm 22 fixed to the substrate 10 and provided around the first diaphragm 21. The first diaphragm 21 and the second diaphragm 22 are deformed by an external sound pressure to sense a sound pressure signal. The second diaphragm 22 includes a plurality of diaphragm flaps 221, and the diaphragm flap 221 includes a fixed end 2211 fixed to one side of the substrate 10, and a movable end 2212 close to one side of the first diaphragm 21 and suspended above the back cavity. The elastically stretchable member 30 is connected to the first diaphragm 21 and the movable end 2212. The elastically stretchable member 30 is configured to give a certain constraint to the movable end 2212, in such a manner that respective movable ends 2212 of the second diaphragm 22 are located on the same plane as much as possible, thereby reducing a performance difference due to a deformation of the second diaphragm 22 itself.

Specifically, four diaphragm flaps 221 are provided, and each of the four diaphragm flaps 221 has a trapezoidal structure. In addition, the four diaphragm flaps 221 are arranged in two-to-two symmetry and spaced apart to define a rectangular space. The first diaphragm 21 has a rectangular shape and is correspondingly located in the rectangular space and spaced apart from the four diaphragm flaps 221. The second diaphragm 22 and the first diaphragm 21 collectively define a rectangular structure of the piezoelectric cantilever diaphragm 20.

It should be noted that, in this embodiment, four diaphragm flaps 221 are provided. Each of the four diaphragm flaps 221 has a trapezoidal structure, and the first diaphragm 21 has a rectangular structure. Correspondingly, the four diaphragm flaps 221 together form a rectangular space, in which the first diaphragm 21 is received. Without doubt, in other embodiments, the number of the diaphragm flaps 221 can be arbitrary. Moreover, the diaphragm flap 221 can also be in any shape, and the first diaphragm 21 can also be of any structure. Correspondingly, a space surrounded by sides of the plurality of the diaphragm flaps 221 close to the first diaphragm 21 may be of any shape, which may be selected as required. Namely, in the present disclosure, the first diaphragm 21 and the second diaphragm 22 may have any structures, as long as the movable end 2212 of the second diaphragm 22 can be restrained by the elastically stretchable member 30 to a certain extent. In the present embodiment, the case where four triangular diaphragm flaps 221 and one rectangular first diaphragm 21 collectively define the piezoelectric cantilever diaphragm 20 having a rectangular structure will be described as an example.

A plurality of the elastically stretchable members 30 is provided, and the plurality of the elastically stretchable members 30 is distributed in an annular array with respect to a center point of the first diaphragm 21.

In an example, the number of the elastically stretchable members 30 is the same as the number of the diaphragm flaps 221, and each of the diaphragm flaps 221 is connected to the first diaphragm 21 by one elastically stretchable member 30.

In this embodiment, four elastically stretchable members 30 are provided and respectively connect the four diaphragm flaps 221 with the first diaphragm 21.

Specifically, the four elastically stretchable members 30 have same structures, and the four elastically stretchable members 30 are rectangular or sector shaped. In this embodiment, each of the four elastically stretchable members 30 has a rectangular structure.

The elastically stretchable member 30 is formed by one or more springs. As an example, the elastically stretchable member 30 is formed of one or more torsion springs so that a torque and an elastic force can be controlled.

It should be noted that, in this embodiment, four elastically stretchable members 30 are provided. The four elastically stretchable members 30 have rectangular structures of a same size and are correspondingly distributed between each diaphragm flap 221 and the first diaphragm 21. In addition, the elastically stretchable member 30 is formed by one or more torsion springs. Without doubt, in other embodiments, the number of elastically stretchable members 30 can be set to any number and has an arbitrary structure. For example, eight elastically stretchable members 30 are provided, each elastically stretchable member 30 has a circular structure, and two elastically stretchable members 30 are provided between the first diaphragm 21 and each of the diaphragm flaps 221. The elastically stretchable members 30 may even be randomly distributed. For example, one elastically stretchable member 30 is provided between one diaphragm flap 221 and the first diaphragm 21, and two elastically stretchable members 30 are provided between the other diaphragm flap 221 and the first diaphragm 21. The elastically stretchable members 30 can have structures of different sizes, such that an adjustment can be better performed between the diaphragm flap 221 and the first diaphragm 21. Moreover, the elastically stretchable member 30 may be made of any material having a function of adjusting the first diaphragm 21 and the second diaphragm 22.

That is to say, the number, distribution position, arrangement, structure shape and material composition of the elastically stretchable members 30 are not limited in the present disclosure, as long as the elastically stretchable member 30 can restrain the movable end 2212 of the second diaphragm 22 and make the gap between the first diaphragm 21 and the second diaphragm 22 relatively uniform. The number, distribution position, arrangement manner, structure shape and material composition of the elastically stretchable member 30 can be selected as required.

Embodiment 2

Figure 4:
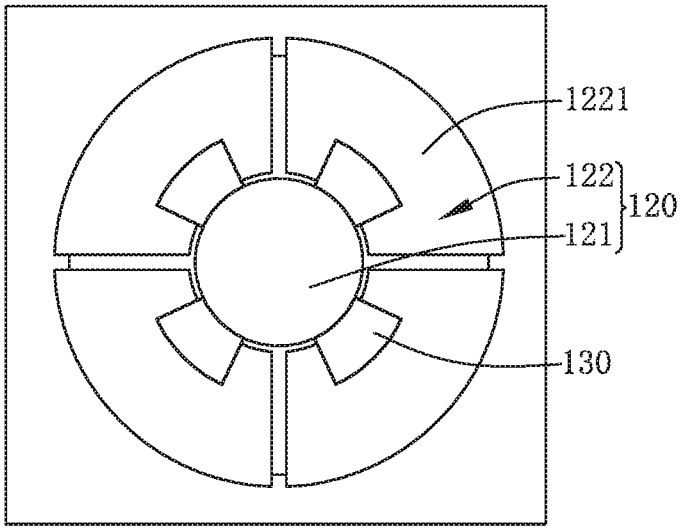
FIG. 4 is a structural schematic diagram of Embodiment 2 of a piezoelectric microphone according to the present disclosure.
Figure 5:
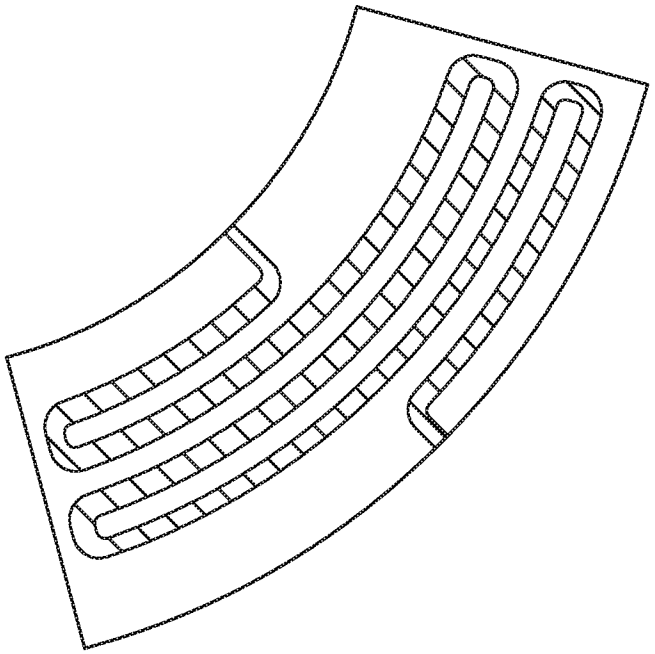
FIG. 5 is a structural schematic diagram of an elastically stretchable member shown in FIG. 4.

Referring to FIG. 4 and FIG. 5 in conjunction, the present embodiment provides a piezoelectric microphone 200. A structure of the piezoelectric microphone 200 is basically the same as that of the piezoelectric microphone 100 in the Embodiment 1, and a difference will be described as follows.

The second diaphragm 122 of the piezoelectric cantilever diaphragm 120 of the piezoelectric microphone 200 includes four sector-ring shaped diaphragm flaps 1221, and the first diaphragm 121 of the piezoelectric cantilever diaphragm 120 has a circular shape. The four diaphragm flaps 1221 are arranged in two-to-two symmetry and spaced apart to define a circular space. The first diaphragm 121 is correspondingly located in the circular space and spaced apart from the diaphragm flap 1221. The second diaphragm 122 and the first diaphragm 121 collectively define a circular structure of the piezoelectric cantilever diaphragm 120.

Moreover, four elastically stretchable members 130 are provided, and the four elastically stretchable members 130 all have sector-ring structures of same sides. Each of the elastically stretchable members 130 connects the first diaphragm 121 with one of the diaphragm flaps 1221.

Compared with the related art, the piezoelectric microphone of the present disclosure, by connecting the movable end of the second diaphragm with the first diaphragm through the elastically stretchable member, restrains the movable end of the second diaphragm to a certain extent, in such a manner that the movable end of the second diaphragm is located on the same plane as much as possible. This reduces the performance difference due to the deformation of the second diaphragm itself, thereby improving the uniformity of the structure and thus improving the consistency of product performance, so that the piezoelectric microphone has better usage performance.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A piezoelectric microphone, comprising:

a substrate having a back cavity;

a piezoelectric cantilever diaphragm fixed to the substrate; and one or more elastically stretchable members, wherein the piezoelectric cantilever diaphragm comprises a first diaphragm located at a center of the piezoelectric cantilever diaphragm and suspended above the back cavity, and a second diaphragm fixed to the substrate and provided around the first diaphragm, the second diaphragm comprises a fixed end fixed to one side of the substrate and a movable end close to one side of the first diaphragm and suspended above the back cavity, and each of the one or more elastically stretchable members connects the first diaphragm with the movable end.

2. The piezoelectric microphone as described in claim 1, wherein the one or more elastically stretchable members comprise a plurality of the elastically stretchable members, the second diaphragm comprises a plurality of diaphragm flaps, and a number of the plurality of elastically stretchable members is identical to a number of the plurality of diaphragm flaps, and each of the plurality of diaphragm flaps is connected to the first diaphragm by one of the plurality of elastically stretchable members.

3. The piezoelectric microphone as described in claim 2, wherein the plurality of the elastically stretchable members is distributed in an annular array with respect to a center point of the first diaphragm.

4. The piezoelectric microphone as described in claim 3, wherein the plurality of the elastically stretchable members has same structures.

5. The piezoelectric microphone as described in claim 1, wherein each of the one or more elastically stretchable members has a rectangular shape or a sector shape.

6. The piezoelectric microphone as described in claim 1, wherein each of the one or more elastically stretchable members is formed of one or more springs.

7. The piezoelectric microphone as described in claim 6, wherein each of the one or more springs is a torsion spring.

8. The piezoelectric microphone as described in claim 2, wherein the plurality of diaphragm flaps comprises four diaphragm flaps, each of the four diaphragm flaps has a trapezoidal structure, the four diaphragm flaps are arranged in two-to-two symmetry and spaced apart from each other to define a rectangular space, the first diaphragm is rectangular and correspondingly located in the rectangular space, and the second diaphragm and the first diaphragm together define a rectangular structure of the piezoelectric cantilever diaphragm.

9. The piezoelectric microphone as described in claim 2, wherein the plurality of diaphragm flaps comprises four diaphragm flaps, each of the four diaphragm flaps has a sector-ring shaped structure, the four diaphragm flaps are arranged in two-to-two symmetry and spaced apart from each other to define a circular space, the first diaphragm is circular and correspondingly located in the circular space, and the second diaphragm and the first diaphragm together define a circular structure of the piezoelectric cantilever diaphragm.

* * * * *